US008215222B1

(12) United States Patent
Rosenberger et al.

(10) Patent No.: US 8,215,222 B1
(45) Date of Patent: Jul. 10, 2012

(54) SYSTEM, METHOD, AND APPARATUS FOR IMPROVING THE PERFORMANCE OF CERAMIC ARMOR MATERIALS WITH SHAPE MEMORY ALLOYS

(75) Inventors: Brian T. Rosenberger, Aledo, TX (US); Craig A. Brice, Keller, TX (US); Slade H. Gardner, Fort Worth, TX (US); Nathan L. Weber, Fort Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 715 days.

(21) Appl. No.: 11/894,916

(22) Filed: Aug. 22, 2007

(51) Int. Cl.
*F41H 5/02* (2006.01)

(52) U.S. Cl. ..... 89/36.02; 89/903

(58) Field of Classification Search ..... 89/36.01, 89/36.02

See application file for complete search history.

(56) References Cited

U.S. PATENT DOCUMENTS

| | | | | |
|---|---|---|---|---|
| 3,628,248 | A * | 12/1971 | Kroder et al. | 433/175 |
| 4,297,779 | A * | 11/1981 | Melton et al. | 29/446 |
| 5,254,837 | A | 10/1993 | Grimaldi et al. | |
| 6,363,867 | B1 | 4/2002 | Tsilevich | |
| 6,510,777 | B2 | 1/2003 | Neal | |
| 6,860,186 | B2 | 3/2005 | Cohen | |
| 7,082,868 | B2 | 8/2006 | Reichman | |
| 2004/0025985 | A1 | 2/2004 | van Schoor et al. | |
| 2005/0211870 | A1 * | 9/2005 | Browne et al. | 249/134 |
| 2007/0213825 | A1 * | 9/2007 | Thramann | 623/17.11 |

FOREIGN PATENT DOCUMENTS

| | | | |
|---|---|---|---|
| DE | 3447088 | A1 | 7/1986 |
| EP | 1363101 | A1 | 11/2003 |
| FR | 2526535 | | 11/1983 |
| JP | 60158546 | A | 8/1985 |
| JP | S60-158546 | | 8/1985 |
| JP | 03208310 | A | 9/1991 |

* cited by examiner

*Primary Examiner* — Michael Carone
*Assistant Examiner* — Reginald Tillman, Jr.
(74) *Attorney, Agent, or Firm* — Bracewell & Giuliani LLP

(57) ABSTRACT

Ring-shaped shape memory alloys put disk-shaped ceramic materials in a state of compression. The rings are radially deformed to introduce plastic strain into the rings. The rings are sized to closely receive the disk-shaped ceramic strike plates. When the assembly is heated, the rings attempt to regain their original shape and thereby put the ceramic strike plates into uniform, two-dimensional compression.

12 Claims, 2 Drawing Sheets

SYSTEM, METHOD, AND APPARATUS FOR IMPROVING THE PERFORMANCE OF CERAMIC ARMOR MATERIALS WITH SHAPE MEMORY ALLOYS

BACKGROUND OF THE INVENTION

1. Technical Field

The present invention relates in general to ceramic armor materials and, in particular, to an improved system, method, and apparatus for improving the performance of ceramic armor materials with shape memory alloys that retain the ceramic in a state of compression.

2. Description of the Related Art

In the prior art, there are numerous types of ballistic armor used to defend targets. Metals and metallic alloys are the most common materials used to fabricate armor, but other materials such as plastics, woven materials, and ceramics also have been used. Multi-layered armors formed from dissimilar materials (e.g., a ceramic strike plate on a metallic base) are also known and suitable for some applications.

Ceramic materials are very strong in compression, but weak in tension. They are also very brittle, but can have significant strength after fracture when under compression. They also tend to be lightweight when compared to other materials such as metals. These characteristics make ceramics well suited for armor applications, but also make them very complex and difficult to understand.

When ceramic armor is impacted by a projectile, one of its primary failure mechanisms is through propagation of an acoustic wave to the back surface of the ceramic strike plate. The acoustic wave reflects off the interface and puts the back face of the ceramic material in tension. As described above, ceramic materials respond poorly to tensile loads such that a ceramic strike plate fails due to cracking that originates at the back face of the strike plate.

One solution to this problem puts the back face of the ceramic strike plate in residual compression in order to increase the amount of load that the strike-plate can withstand before failure begins. For example, the coefficient of thermal expansion (CTE) mismatch between the ceramic and metallic materials may be used advantageously in this manner. Since metals thermally expand much more readily than ceramic materials, the entire armor system may be heated to elevated temperature (e.g., >500° C.) such that the dissimilar materials are bonded together at the elevated temperature before being cooled to form the bonded product. Upon cooling, the metal shrinks more than the ceramic but is constrained by the bond between them so that the ceramic receives residual compressive stresses at its interfacing surface with the metal. Unfortunately, the amount of strain recoverable (approximately 0.3%) also is limited by thermal expansion/contraction considerations. In addition, this method requires difficult assembly procedures in high temperature furnaces with complex tooling requirements. Thus, an improved solution for joining dissimilar materials for ballistic armor applications would be desirable.

SUMMARY OF THE INVENTION

Embodiments of a system, method, and apparatus for improving the performance of ceramic armor materials with shape memory alloys are disclosed. The shape memory alloys are ring-shaped and put the disk-shaped ceramic in a state of compression. The ring is formed at a selected height, such as cutting the ring from a tube of shape memory alloy, and then radially deformed to introduce plastic strain into the ring. The ring is sized to just slip over a disk-shaped ceramic strike plate. When this assembly is heated, the ring attempts to regain its original, smaller shape and thereby puts the ceramic strike plate into uniform, two-dimensional compression.

This solution does not require bonding of or any other interface layers between the shape memory alloy to the ceramic armor strike plate. Any complications of the bond joint and interface material are avoided with this solution.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
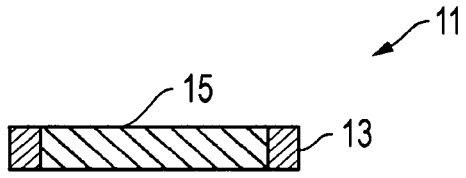
FIG. 1 is a sectional side view of one embodiment of armor constructed in accordance with the present invention.

Referring to FIGS. 1-5, one embodiment of a system, method, and apparatus for improving the performance of ceramic armor materials with shape memory alloys are disclosed. As shown in FIG. 1, the invention comprises an assembly 11 that is suitable for use as armor, comprising a ceramic strike plate shaped in a disk 15. The assembly also comprises a shape memory alloy (e.g., Ni—Ti, nitinol, etc.) shaped in a ring 13 that circumscribes the disk 15 such that the ceramic strike plate is in a state of compression (e.g., uniform two-dimensional compression). In one embodiment, the disk 15 and the ring 13 are not bonded together and free of any other interface layers therebetween.

Figure 3:
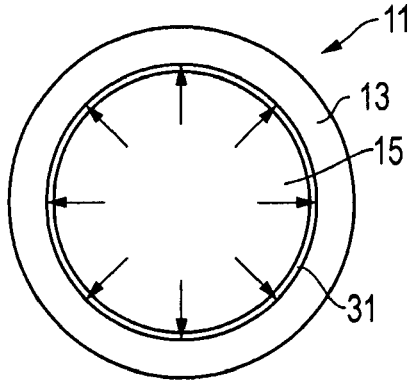
FIG. 3 is a front view of one embodiment of a shape memory alloy and ceramic material at an initial stage of assembly in accordance with the present invention.
Figure 4:
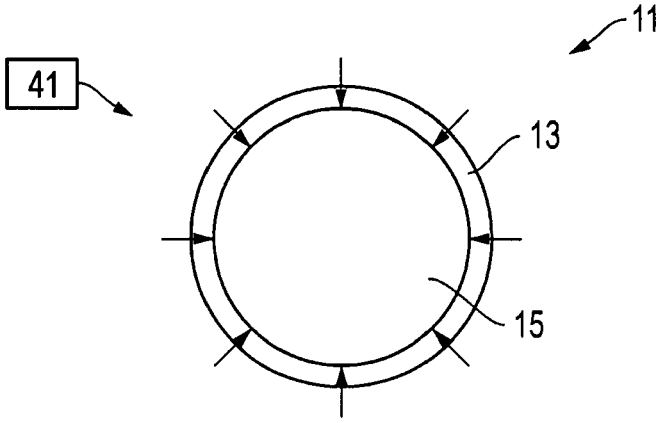
FIG. 4 is a schematic front view of the shape memory alloy and ceramic material at an later stage of assembly in accordance with the present invention.
Figure 5:
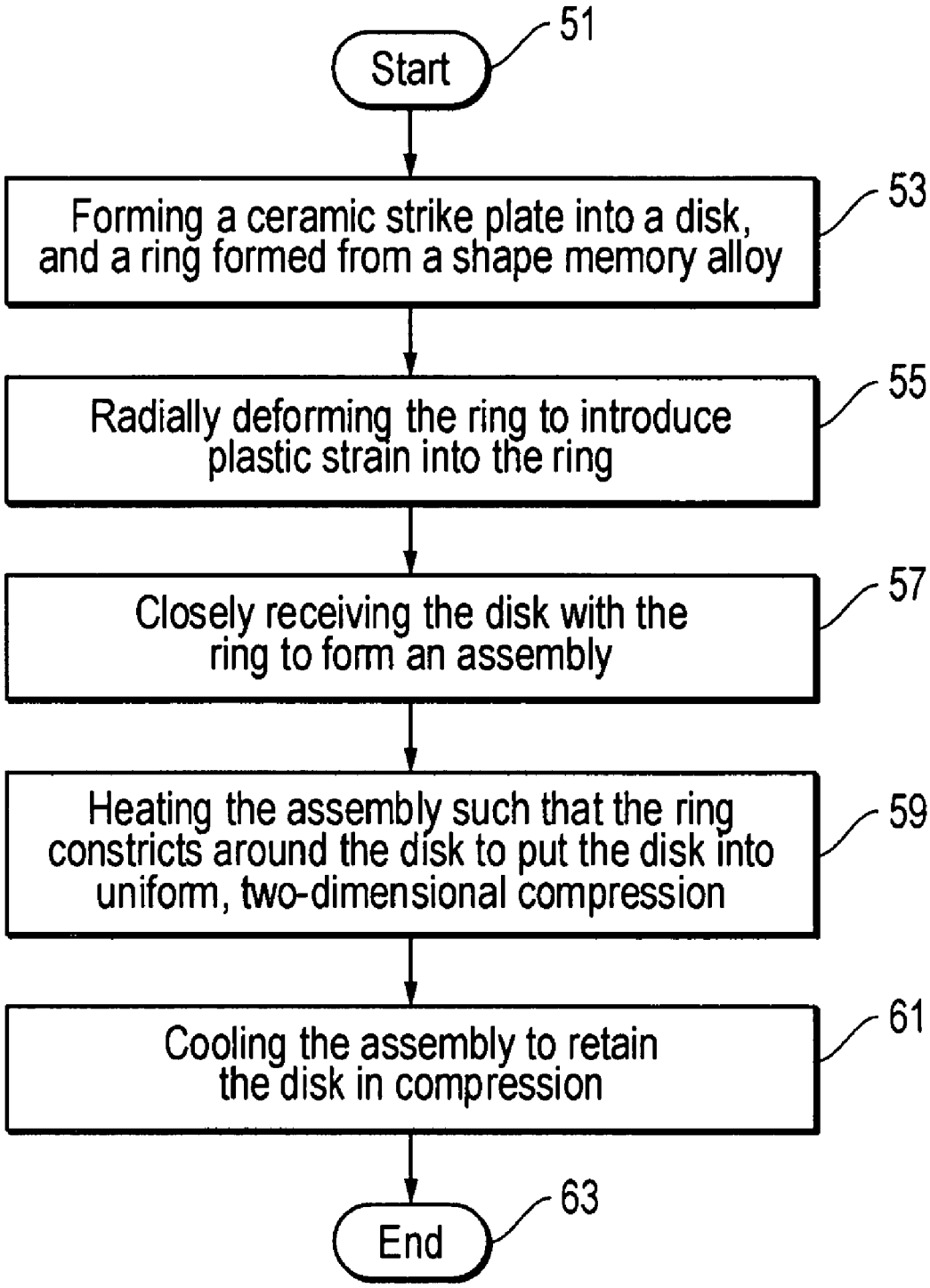
FIG. 5 is a high level flow diagram of one embodiment of a method in accordance with the invention.

The invention also comprises a method of forming an assembly. In one embodiment (FIG. 5), the method begins as indicated at step 51 and comprises providing a ceramic material 15 (e.g., $Al_2O_3$, $B_4C$, SiC, etc.) and a shape memory alloy (SMA) 13 (step 53); deforming the SMA to introduce plastic strain into the SMA (step 55). The plastic strain may comprise on the order of up to about 8%. The ceramic material is surrounded with the SMA to form an assembly 11 as shown in FIG. 3 (step 57), and the assembly is heated 41 (FIG. 4). The temperature range used for the SMA may be tailored by adjusting its alloy chemistry. The heating step constricts the SMA 13 around (see arrows pointing radially inward) the ceramic material 15 to put the ceramic material into compression (step 59). The assembly is then cooled to retain the ceramic material in compression with the SMA (step 61); before ending as indicated at step 63. There may be a small amount of additional stress (i.e., from CTE mismatch) between the components after the assembly cools.

Figure 2:
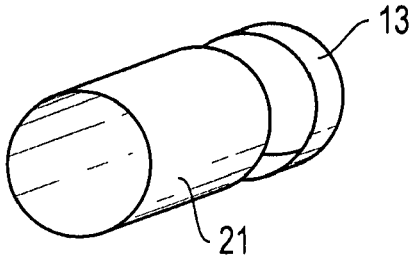
FIG. 2 is an isometric view of one embodiment of a shape memory alloy forming step constructed in accordance with the present invention.

In other embodiments, the method may comprise forming the ceramic material in a disk and the SMA in a ring. As shown in FIG. 2, a tube 21 of the shape memory alloy may be formed such that a ring 13 is cut from the tube 21. Referring to FIG. 3, the ring 13 has a bore that closely receives the disk 15 (e.g., tolerance fit) such that only a very small space 31 (shown exaggerated for purposes of illustration) extends between the ring 13 and disk 15. In another embodiment (FIG. 3), the ring 13 is radially deformed (see arrows extending radially outward) prior to assembly to the disk 15.

For example, one embodiment of the invention comprises a method of forming armor, comprising: forming a ceramic strike plate into a disk, and a ring formed from a shape memory alloy; radially deforming the ring to introduce plastic strain into the ring; closely receiving the disk with the ring to form an assembly; heating the assembly such that the ring constricts around the disk to put the disk into uniform, two-dimensional compression; and then cooling the assembly to retain the disk in compression.

While the invention has been shown or described in only some of its forms, it should be apparent to those skilled in the art that it is not so limited, but is susceptible to various changes without departing from the scope of the invention.

What is claimed is:

1. A method of forming a ballistic armor assembly, comprising:

(a) providing a ballistic armor strike plate that is a solid disk, free of holes therethrough and formed from ceramic material that is suitable for use as armor, and providing a shape memory alloy (SMA) ring, the SMA ring being formed in a solid ring having a height substantially the same as a height of the disk, the SMA ring having a bore with an inner diameter initially smaller than an outer diameter of the strike plate;

(b) deforming the SMA ring to introduce plastic strain into the SMA ring and increase the inner diameter of the bore of the SMA ring to a dimension greater than the outer diameter of the strike plate; then (c) inserting the strike plate into the bore of the SMA ring to form an assembly; then (d) heating the assembly such that the bore of the SMA ring constricts around the outer diameter of the ceramic material of the strike plate to put the ceramic material into compression; and then (e) cooling the assembly to retain the ceramic material of the strike plate in compression with the SMA ring.

2. A method according to claim 1, wherein step (a) comprises forming a tube of SMA material and cutting the SMA ring from the tube.

3. A method according to claim 1, wherein step (b) comprises plastically deforming the SMA ring up to 8% plastic strain.

4. A method according to claim 1, wherein step (d) comprises uniform two-dimensional compression.

5. A method according to claim 1, wherein the bore of the SMA ring is in direct contact with the outer diameter of the ceramic material of the strike plate, is not bonded to the ceramic material of the strike plate, and is free of any other interface layers between the bore of the SMA ring and the ceramic material of the strike plate.

6. A method according to claim 1, wherein the ceramic material is selected from the group consisting of $Al_2O_3$, $B_4C$ and SiC.

7. A method of forming ballistic armor, comprising:

(a) forming a ceramic ballistic armor strike plate into a solid disk having an outer diameter and being free of any holes therethrough, and forming a solid ring from a shape memory alloy, wherein the ring has a height substantially the same as a height of the disk and has a bore that initially has an inner diameter less than the outer diameter of the disk;

(b) radially deforming the ring to enlarge the bore of the ring greater than the outer diameter of the disk and introduce plastic strain into the ring to retain the bore in the enlarged condition; then (c) inserting the disk into the ring while the bore is still in the enlarged condition to form an assembly, the assembly being free of any interface layers between the inner diameter of the ring and the outer diameter of the disk;

(d) heating the assembly such that the bore of the ring constricts from the enlarged condition around the disk to grip the disk and put the disk into uniform, two-dimensional compression; and then (e) cooling the assembly to retain the disk in compression.

8. A method according to claim 7, wherein step (a) comprises forming a tube of the shape memory alloy and cutting the ring from the tube.

9. A method according to claim 7, wherein the amount of the plastic strain does not exceed 8%.

10. A method according to claim 7, wherein the ceramic material is selected from the group consisting of $Al_2O_3$, $B_4C$ and SiC.

11. A ballistic armor, comprising:

a ceramic strike plate comprising a solid disk of ceramic material having an outer diameter and being free of any holes therethrough; and a shape memory alloy shaped into a solid ring with a height substantially the same as a height of the disk and having bore circumscribing the ceramic strike plate such that the ceramic strike plate is in a state of compression, the ceramic strike plate and the ring being free of any interface layers between the outer diameter of the ceramic strike plate and the bore of the ring.

12. An armor according to claim 11, wherein the state of compression is uniform, two-dimensional compression.

* * * * *